US010777922B2

(12) United States Patent
Huang et al.

(10) Patent No.: US 10,777,922 B2
(45) Date of Patent: Sep. 15, 2020

(54) FLAT WIRE DIRECT COUPLING CONNECTOR

(71) Applicant: P-TWO INDUSTRIES INC., Taoyuan (TW)

(72) Inventors: Chiao-Yun Huang, Taoyuan (TW); Shien-Chang Lin, Taoyuan (TW)

(73) Assignee: P-TWO INDUSTRIES INC., Taoyuan (TW)

( * ) Notice: Subject to any disclaimer, the term of this patent is extended or adjusted under 35 U.S.C. 154(b) by 0 days.

(21) Appl. No.: 16/394,214

(22) Filed: Apr. 25, 2019

(65) Prior Publication Data

US 2020/0227845 A1 Jul. 16, 2020

(30) Foreign Application Priority Data

Jan. 11, 2019 (TW) ..... 108101447 A

(51) Int. Cl.
*H01R 12/71* (2011.01)
*H01R 13/627* (2006.01)
*H01R 13/631* (2006.01)

(52) U.S. Cl.
CPC ..... *H01R 12/716* (2013.01); *H01R 13/6271* (2013.01); *H01R 13/631* (2013.01)

(58) Field of Classification Search
CPC H01R 12/70; H01R 12/7011; H01R 12/7076; H01R 12/7082; H01R 12/712; H01R 12/716; H01R 12/77; H01R 12/772; H01R 12/774
See application file for complete search history.

(56) References Cited

U.S. PATENT DOCUMENTS 7,559,772 B2 * 7/2009 Tsai ..... H01R 12/592 439/495
7,789,700 B2 * 9/2010 Wang ..... H01R 12/62 439/507
7,833,049 B2 * 11/2010 Wang ..... H01R 12/61 439/497
8,287,311 B2 * 10/2012 Lin ..... H01R 9/05 439/607.55
9,685,718 B1 * 6/2017 Wang ..... H01R 12/716
9,761,975 B1 * 9/2017 Wang ..... H01R 12/716
10,205,259 B2 * 2/2019 Wang ..... H01R 12/79
10,312,617 B2 * 6/2019 Wang ..... H01R 12/77

* cited by examiner

*Primary Examiner* — James Harvey
*Assistant Examiner* — Matthew T Dzierzynski
(74) *Attorney, Agent, or Firm* — Sinorica, LLC

(57) ABSTRACT

The invention discloses a flat wire direct coupling connector for buckling a fixing device and for connecting to a flat wire, which comprises a first connecting portion and a second connecting portion. The first connecting portion can be buckled on the fixing device by a first hook of the first connecting portion, and a first aligning unit of the first connecting portion and the second aligning unit of the second connecting portion are moved in the opposite position. Thereafter, a second hook of the second connecting portion is inserted into the first opening of the first connecting portion and a third hook of the second connecting portion is inserted into a second opening of the first connecting portion for the flat wire to be inserted into the side edge of insert from at least one of a first insertion opening and a second insertion opening of the second connecting portion.

10 Claims, 5 Drawing Sheets

FLAT WIRE DIRECT COUPLING CONNECTOR

FIELD OF THE INVENTION

The present invention belongs to the field of connectors, and more particularly, a flat wire direct coupling connector that can be fixed into a fixing device and guides a flat wire to be directly coupled with a circuit board.

BACKGROUND OF THE INVENTION

In some applications, the flat wire will be electrically connected directly to a circuit board, whereas the conventional method is to solder the flat wire directly to the circuit board through surface mount technology.

The surface mount technology allows the flat wire to be electrically connected to the circuit board; however, if modification is required, the flat wire must be detached from the circuit board by separating the soldered part, which will result in inconvenience and complication in maintenance and error correction.

Therefore, the present invention provides a flat wire direct coupling connector for solving the defect caused by the conventional connector.

SUMMARY OF THE INVENTION

The first objective of the present invention is to provide a flat wire direct coupling connector that can be buckled directly onto a fixing device and guides a flat wire to be connected to a circuit board through a connector.

The second objective of the present invention is that the flat wire direct coupling connector can be separated into a first connecting portion and a second connecting portion, and by means of the openings and the hooks between the first connecting portion and the second connecting portion being buckled each other, the first connecting portion and the second connecting portion can be bonded tightly.

The third objective of this invention is to provide a flat wire direct coupling connector in accordance with the aforementioned, the alignment units are disposed respectively in the first connecting portion and the second connecting portion to accomplish smooth integration.

In order to achieve the above and other objectives, the present invention provides a flat wire direct coupling connector which is buckled on a fixing device and applied to a flat wire. The flat wire direct coupling connector includes a first connecting portion and a second connecting portion. The first connecting portion forms a first opening, a second opening and a third opening. The first connecting portion has a first hook and a first alignment unit. The second connecting portion forms a second alignment unit. The second connecting portion has a diverging member, a second hook, a third hook and an insert. Wherein, the diverging member forms a first insertion opening and a second insertion opening in the second connecting portion. The first connecting portion can be buckled on the fixing device by the first hook, and after the first aligning unit and the second aligning unit are moved in alignment, the diverging member passes through the third opening, the second hook is inserted into the first opening and the third hook is inserted into the second opening, so that the flat wire is inserted into the side edge of the insert from at least one of the first insertion opening and the second insertion opening.

Compared with the prior technology, the flat wire direct coupling connector provided by the present invention can be directly disposed in the fixing device, so that the flat wire inside the fixing device can be passed through the connector for combining with the external circuit board.

DETAILED DESCRIPTION OF EMBODIMENTS

In order to fully understand the objects, features, and advantages of the present invention, the embodiments of the present invention will be described in detail with the accompanying drawings.

In the present invention, "a" or "an" is used to describe the various elements, parts and components. This is done for convenience of description only and provides a general meaning to the scope of the invention.

Therefore, unless expressly stated otherwise, the description should be understood to include one, at least one, and the singular also includes the plural.

In the context of the present invention, the terms "comprising", "including", "having" or "containing" are intended to encompass non-exclusive inclusions. For example, an element, structure, article, or device that comprises a plurality of elements is not limited to such elements as listed herein but may include those not specifically listed but which are generally inherent in the element, structure, article, or device. In addition, the term or is used to mean an inclusive "or" rather than an exclusive "or" unless expressly stated to the contrary.

Figure 1:
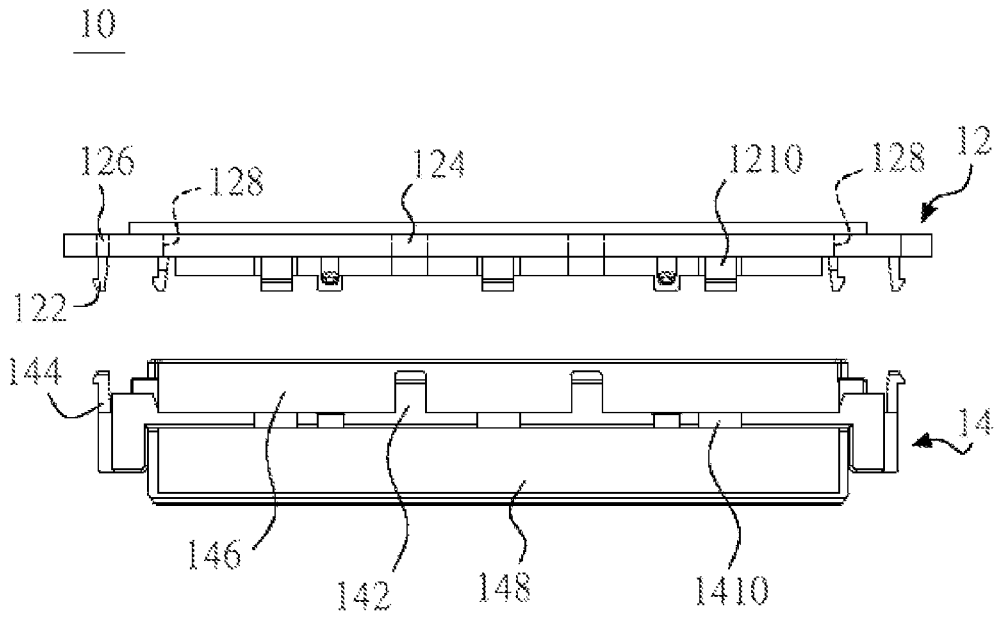
FIG. 1 represents a schematic structural view of the flat wire direct coupling connector according to the first embodiment of the present invention.

Please refer to FIG. 1, which is a structural schematic diagram of a flat wire direct coupling connector according to the first embodiment of the present invention. In FIG. 1, the flat wire direct coupling connector 10 includes a first connecting portion 12 and a second connecting portion 14.

Figure 2:
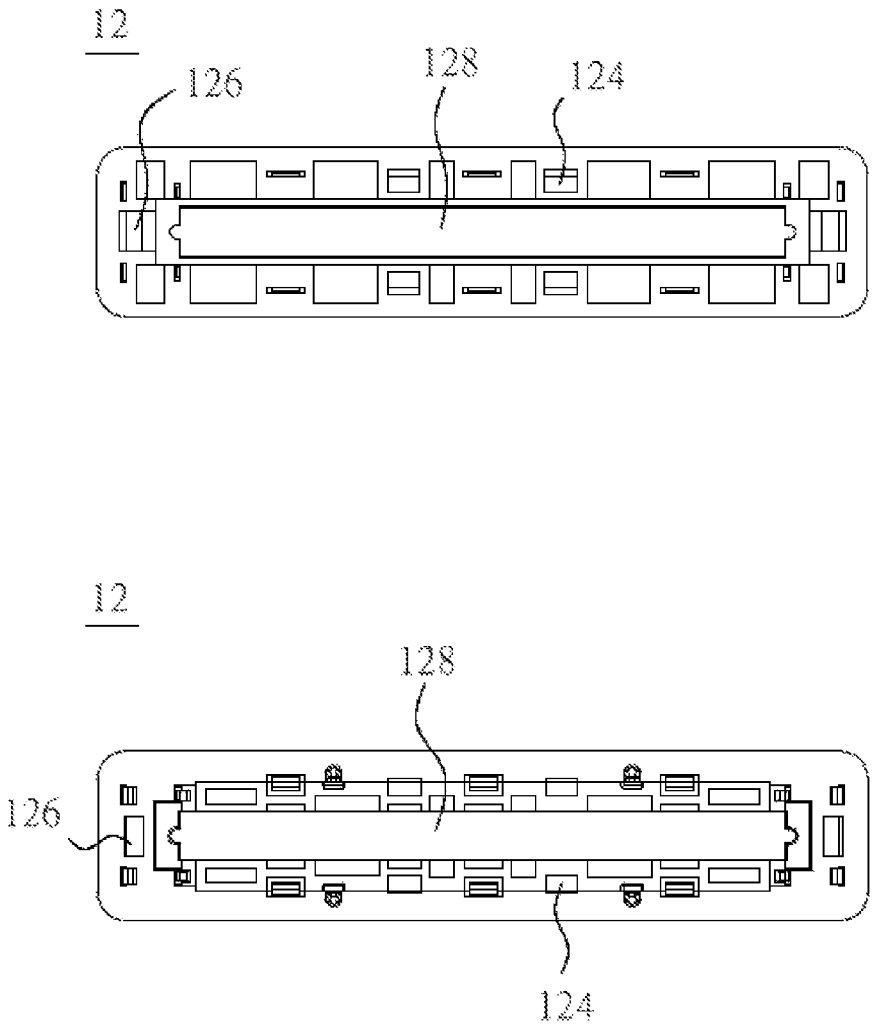
FIG. 2 are respectively a plan view and a bottom view illustrating the first connecting portion of FIG. 1 of the present invention.
Figure 5:
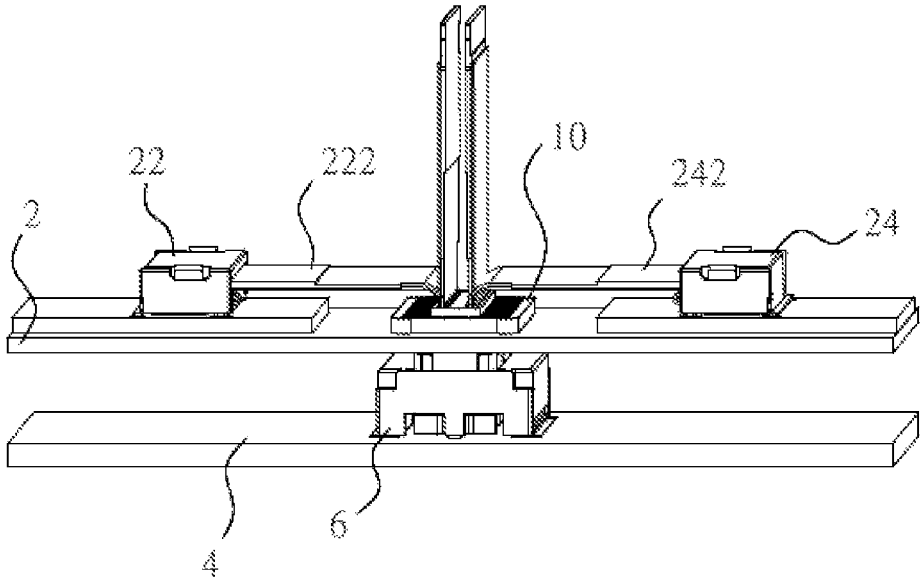
FIG. 5 is a schematic diagram showing the flat wire direct coupling connector of FIG. 1 clamped on the fixing device and applied to the first wire and the second wire of the present invention.

FIG. 2 can be considered together, a plan view and a bottom view of the first connecting portion 12 of FIG. 1 of the present invention are respectively described. The first connecting portion 12 defines a first opening 124, a second opening 126 and a third opening 128. In the embodiment, the first connecting portion 12 is exemplified by a rectangle, and other shapes may be used in other embodiments. The rectangular first connecting portion 12 has a long side and a short side. There are four first openings 124 at the edges of the long sides and two second openings 126 at the short sides, that is, the number of the first openings 124 and the number of the second openings 126 are respectively set in pairs to provide a corresponding force for firmly fastening the first connecting portion 12 to the fixing device 2 (as shown in FIG. 5). The third opening 128 is at a central portion of the first connecting portion 12. In this embodiment, the width of the third opening 128 is equal to or greater than the width of the flat wire (which may refer to the first wire 222 and the second wire 242 of FIG. 5).

The first connecting portion 12 includes a first hook 122 and a first alignment unit 1210. The number of the first hooks 122 is eight and is respectively disposed on the lower side of the first connecting portion 12, as shown in FIG. 1. The first hook 122 has a leg. In the present embodiment, the hook legs extend outward to enable the fastening device 2 to be buckled. Also, the length of the first hook 122 may be set to be equal to or smaller than the thickness of the fixing device 2. The first aligning unit 1210 is exemplified by a cylinder (or a rib), and may be a slot in other embodiments, which belongs to the scope of the present invention as long as it can be aligned with the subsequent second aligning unit 1410. It is worth noting that the foregoing numbers are for illustrative purposes only and are not intended to be limiting.

Figure 3:
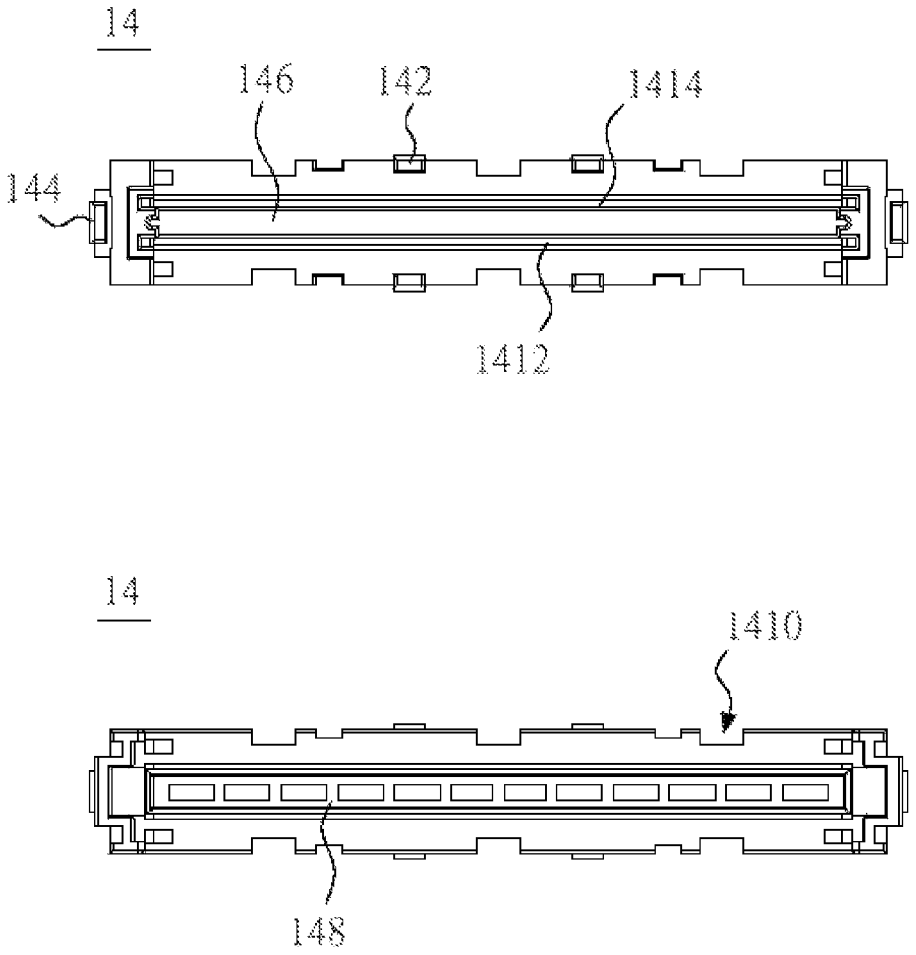
FIG. 3 are respectively a plan view and a bottom view of the second connecting portion of FIG. 1 of the present invention.

FIG. 3 can be considered together, a plan view and a bottom view of the second connecting portion 14 of FIG. 1 of the present invention will be respectively described. The second connecting portion 14 forms a second aligning unit 1410. The second aligning unit 1410 is exemplified by a slot for engaging the first aligning unit 1210 of the cylindrical shape. The second connecting portion 14 is exemplified by a rectangular shape and may be other shapes in other embodiments. The rectangular second connecting portion 14 also has a long side and a short side. The second connecting portion 14 has a diverging member 146, a second hook 142, a third hook 144 and an insert 148. The diverging member 146 is formed on a central portion of the second connecting portion 14 to form a first insertion opening 1412 and a second insertion opening 1414 in the second connecting portion 14. The slit width of the first insertion opening 1412 and the second insertion opening 1414 is equal to or larger than the thickness of the flat wire for the flat wire to be passed through. The insert 148 can be used to be interposed in a circuit board 4 having a slot 6 such as that of FIG. 5, which can be stably disposed in the flat wire direct coupling connector 10.

Figure 4:
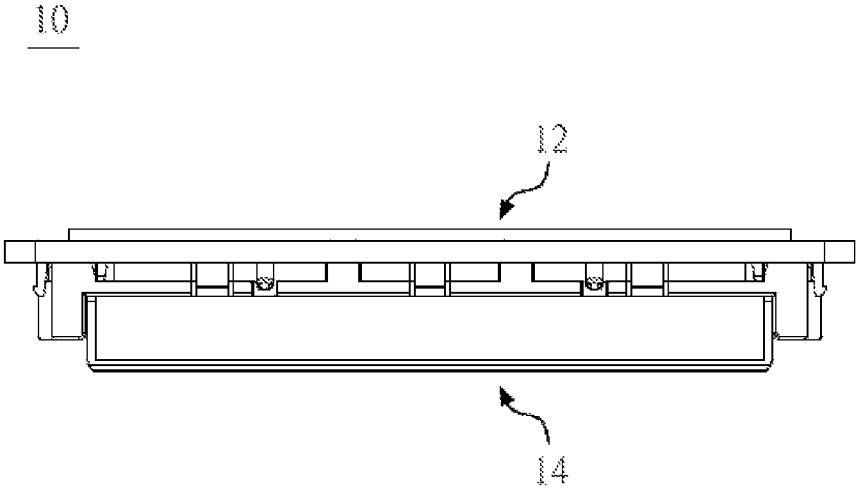
FIG. 4 represents a schematic diagram showing the combination of the first connecting portion and the second connecting portion of FIG. 1 of the present invention.

Referring to FIG. 4, a schematic view of the combination of the first connecting portion 12 and the second connecting portion 14 of FIG. 1 is illustrated. After the first connecting portion 12 is coupled with the second connecting portion 14, the first connecting portion 12 can be buckled on the fixing device 2 by the first hook 122, so that the first connecting portion 12 can be firmly fixed to the fixing device 2. During the combination of the first connecting portion 12 and the second connecting portion 14, the first aligning unit 1210 and the second aligning unit 1410 are moved in alignment to allow the diverging member 146 to be passed through the third opening 128. At the same time, the second hook 142 is also inserted into the first opening 124 to be buckled, and the third hook 144 is inserted into the second opening 126 to be buckled, the flat wire is threaded into the side edge of the insert 148 from the first insertion opening 1412 and/or the second insertion opening 1414.

Referring to FIG. 5, a schematic view of how the flat wire direct coupling connector 10 of FIG. 1 is clamped on the fixing device 2 and can be applied to the first wire 222 and the second wire 242, is illustrated. In FIG. 5, the fixing device 2 is designed with an inner circuit board, and the inner circuit board is provided with a first connector 22 and a second connector 24. For example, the first connector 22 and the second connector 24 can be a type of connector having auto-lock mode. One end of the first wire 222 and the second wire 242 can be respectively and automatically locked and electrically connected, while the other end of the first wire 222 and the second wire 242 can be passed through the fixing device 2 by means of the first insertion opening 1412 and second insertion opening 1414 of the flat wire direct coupling connector 10. At this time, the second connecting portion 14 of the flat wire direct coupling connector 10 is inserted into the slot 6 by means of the insert 148, so that the first wire 222 and the second wire 242 are directly coupled to the circuit board 4, in order to enable the other end of the first wire 222 and the second wire 242 to be electrically connected to the circuit board 4.

The above-mentioned embodiments are merely illustrative of the technical ideas and features of the present invention, the purpose thereof is to enable those skilled in the art to understand the contents of the present invention and are not intended to limit the scope of the invention. It should be noted that any equivalent changes and replacements to the embodiments should all be set to be within the scope of the present invention. Therefore, the scope of protection of the present invention shall be defined by the patent application area.

What is claimed is:

1. A flat wire direct coupling connector for buckling a fixing device and for being applied to a flat wire, the flat wire direct coupling connector comprising:

a first connecting portion forming a first opening, a second opening and a third opening, the first connecting portion has a first hook and a first alignment unit;

a second connecting portion forming a second alignment unit, the second connecting portion has a diverging member, a second hook, a third hook and an insert, wherein, the diverging member forms a first insertion opening and a second insertion opening in the second connecting portion;

wherein, the first connecting portion is buckled on the fixing device by the first hook, and after the first aligning unit and the second aligning unit are moved in alignment, the diverging member is passed through the third opening, the second hook is inserted into the first opening and the third hook is inserted into the second opening, so that the flat wire is inserted into the side edge of the insert from at least one of the first insertion opening and the second insertion opening.

2. The flat wire direct coupling connector according to claim 1, wherein the first opening and the second opening are formed on the outer edge of the first connecting portion, the third opening is formed on a central portion of the first connecting portion.

3. The flat wire direct coupling connector according to claim 2, wherein the first connecting portion is shaped as a rectangle, the first opening and the second opening are formed on the outer edge of the rectangle, the first opening is formed on the longer side of the rectangle and the second opening is formed on the shorter side of the rectangle.

4. The flat wire direct coupling connector according to claim 3, wherein the number of the first openings and the number of the second openings are respectively set in pairs.

5. The flat wire direct coupling connector according to claim 1, wherein the diverging member is formed on a central portion of the second connecting portion, and the diverging member forms a first insertion opening and a second insertion opening in a central portion.

6. The flat wire direct coupling connector according to claim 5, wherein the second connecting portion is shaped as a rectangle, the second hook and the third hook are formed on the outer edge of the rectangle, the second hook is formed on the longer side of the rectangle, and the third hook is formed on the shorter side of the rectangle.

7. The flat wire direct coupling connector according to claim 1, wherein the insert is inserted into a circuit board with a slot.

8. The flat wire direct coupling connector according to claim 1, wherein the first aligning unit is a cylinder and the second aligning unit is a slot, or the first aligning unit is a slot and the second aligning unit is a cylinder.

9. The flat wire direct coupling connector according to claim 1, wherein a hook leg of the first hook is extended outward.

10. The flat wire direct coupling connector according to claim 9, wherein the length of the first hook may not be greater than the thickness of the fixing device.

* * * * *